US005695417A

United States Patent [19]

Winter et al.

[11] Patent Number: 5,695,417

[45] Date of Patent: Dec. 9, 1997

[54] POWER LIFT BASKETBALL ADJUSTMENT SYSTEM

[76] Inventors: David C. Winter, 1956 E. 2050 North, Layton, Utah 84040; Richard C. Nordgran, 2623 W. 4225 South, Roy, Utah 84067; Coplan E. Vaughan, 2223 S. 2000 West, Syracuse, Utah 84075

[21] Appl. No.: 799,979

[22] Filed: Feb. 12, 1997

[51] Int. Cl.[6] ..... A63B 63/08

[52] U.S. Cl. ..... 473/484; 473/483; 473/482; 473/481; 248/283.1; 248/280.11

[58] Field of Search ..... 473/471, 481, 473/482, 483, 484; 248/283.1, 404, 280.11

[56] References Cited

U.S. PATENT DOCUMENTS

| | | | |
|---|---|---|---|
| D. 350,797 | 9/1994 | Curtis . | |
| 1,924,811 | 8/1933 | Schulz . | |
| 3,427,025 | 2/1969 | Procter . | |
| 3,586,324 | 6/1971 | Bearson . | |
| 3,765,676 | 10/1973 | Bearson et al. . | |
| 3,802,702 | 4/1974 | Pulley . | |
| 4,395,040 | 7/1983 | White . | |
| 4,438,923 | 3/1984 | Engle et al. . | |
| 4,441,709 | 4/1984 | Schroeder et al. . | |
| 4,781,375 | 11/1988 | Nye . | |
| 4,801,142 | 1/1989 | Friesen | 473/484 |
| 4,805,904 | 2/1989 | Nye . | |
| 4,846,469 | 7/1989 | Nye . | |
| 4,881,734 | 11/1989 | Nye . | |
| 5,133,547 | 7/1992 | Pardi | 473/484 |
| 5,259,612 | 11/1993 | Mathernet et al. | 473/484 |
| 5,465,957 | 11/1995 | Schroeder | 473/484 |
| 5,478,068 | 12/1995 | Schroeder | 473/484 |
| 5,601,284 | 2/1997 | Blackwell et al. | 473/483 |

FOREIGN PATENT DOCUMENTS

| | | | |
|---|---|---|---|
| 28616 | 2/1965 | Netherlands | 473/484 |

OTHER PUBLICATIONS

Component Play Grounds, Equipment Brochure, Salt Lake City, Utah, p. 6 date unknown.

Diversified Products, 1990 Equipment Catalog, "DP Fit for Life," Opelika, Alabama, p. 61.

Huffy Sports Catalog, "Basketball's Hottest Products this Year," Waukesha, Wisconsin, p. 21 date unknown.

Huffy Sports, Equipment Catalog, Waukesha, Wisconsin, p. 21 date unknown.

Diversified Products, "25 Years of Innovation," Opelika, Alabama, p. 69 date unknown.

Huffy Sports, "Our All–Star Lineup," Waukesha, Wisconsin, p. 21 date unknown.

Harvard, "1988 Sporting Goods Catalog," p. 8.

Huffy Sports, Equipment Assembly Instruction Sheet, Waukesha, Wisconsin date unknown.

*Primary Examiner*—Raleigh W. Chiu

*Attorney, Agent, or Firm*—Madson & Metcalf, PC

[57] ABSTRACT

An adjustable basketball goal system for adjusting the height of a basketball goal above a playing surface is disclosed. The basketball goal includes a deformable parallelogrammic structure attached at one end to a rigid support. A basketball goal is attached to the other end of the parallelogrammic structure. An adjustment lever is pivotally mounted to the rigid support below the parallelogrammic structure. An extension arm is positioned between the parallelogrammic structure and the adjustment lever such that movement of the adjustment lever deforms the parallelogrammic structure which repositions the basketball goal to a different height above the playing surface. A lockable piston assembly is attached to the rigid support and to the adjustment lever. The piston assembly includes a switch which locks the piston assembly preventing the parallelogrammic structure from deforming. An actuation trigger pivotally connected to the adjustment lever can be engaged to move the switch to an unlocked position thereby allowing the height of the basketball goal to be adjusted. The piston assembly also serves to counterbalance the weight of the basketball goal such that the height of the basketball goal can be adjusted with minimal force.

27 Claims, 6 Drawing Sheets

POWER LIFT BASKETBALL ADJUSTMENT SYSTEM

BACKGROUND

1. The Field of the Invention

The present invention is related to a system for adjusting the height of a basketball goal. More particularly, the present invention is related to a basketball adjustment system having a counterbalanced adjustment lever that allows the basketball goal to be manually adjusted up and down using minimal force.

2. Technical Background

Basketball is an increasingly popular sport in the United States and abroad. There are many cities, counties, and other associations that sponsor recreational and instruction leagues where people of all ages can participate in the sport of basketball. Today there are organized leagues for children as young as five and six years old. Accordingly, is not surprising that more and more people have a basketball goal mounted on their property.

Some basketball goals are adjustable which allows people of all ages and sizes to enjoy the sport because the basketball goal can be positioned at a height lower than the standard height of ten feet. The adjustability of basketball goals has been especially beneficial to children. Many younger children simply don't have the strength to make a basket at the standard height of ten feet. Other children have had to heave the basketball at the higher goal in order to make a basket and in so doing develop improper shooting skills. Additionally, nonadjustable goals sometimes frustrate children and cause them to lose their confidence because the basketball goals are simply to high for children to consistently make a basket. This frustration sometimes causes children to ultimately give up the game.

Many attempts have been made to design a basketball goal which is adjustable to several different heights. Some of these designs employ pivotally mounted parallel bars which connect the basketball backboard to a rigid mounting device such as a pole. The parallel bars combine with the basketball backboard and the rigid mounting device to form a parallelogram. Since the bars are pivotally mounted, they allow the backboard of the basketball goal to move to several different heights while remaining vertically disposed.

In some basketball adjustment systems, once the basketball goal is at the desired height, it is secured in place by tightening one or more bolts which "lock" the parallelogram in place. One of the disadvantages of these devices is that whenever one desires to adjust the basketball goal, it requires the use of a ladder or similar device to enable one to reach the one or more bolts which must be loosened to "unlock" the basketball goal. This is complicated by the fact that when the bolt or bolts are loosened, the person adjusting the goal must support the entire weight of the goal until the goal has been set to the desired height and the bolt or bolts are tightened again.

Other adjustable basketball goals have adjustment systems that are only accessible with the use of a ladder or require the person adjusting the goal to use a long rod or pole to manipulate the adjustment system. Many of these systems also require the person adjusting the goal to support the entire weight of the goal while the height of the goal is being adjusted.

Other adjustable basketball goals are configured such that the weight of the basketball goal bears directly on the adjustment system. For example, one such device uses a crank system that can be turned to shorten or lengthen a post attached to a parallelogrammic structure to deform the parallelogrammic structure and change the height of a basketball goal attached to the structure. The weight of the goal bears directly on the post that is threaded through the crank system.

There are several disadvantages to this type of design. One disadvantage is that with the weight of the goal bearing on the crank system, the crank is harder to turn. Another disadvantage is that it takes several turns of the crank to make an adjustment to the height of the goal of a few feet. Thus, for example, an adjustment from eight feet to ten feet may take a significant amount of time and effort.

These disadvantages are particularly troublesome for children who typically possess less strength and patience than adults. This is unfortunate because it is usually small children who have the greatest need for lowering the basketball goal.

A further disadvantage of some adjustable basketball systems is that once the height of the goal is changed from the standard height of ten feet, it is difficult to reposition the goal to that precise height without a measuring device.

From the foregoing, it will be appreciated that it would be an advancement in the art to provide a basketball adjustment system that can be adjusted without the use of a ladder or a pole. It would be a further advantage to provide such a basketball adjustment system that could be adjusted quickly and with minimal effort so that even a child could adjust it with minimal effort. It would be an additional advantage to provide a way to easily position the goal at a predetermined height above the playing surface.

Such a basketball goal is disclosed and claimed herein.

BRIEF SUMMARY OF THE INVENTION

The present invention is directed to a novel adjustable basketball goal system allowing for adjustment of the height of a basketball goal above a playing surface. The basketball goal system of the present invention includes a rigid support which extends in a substantially upward direction. The rigid support has a goal side and a back side opposite the goal side.

A deformable parallelogrammic structure is pivotally attached to the goal side of the rigid support such that the parallelogrammic structure is suspended above the playing surface. The parallelogrammic structure includes an upper support and a lower support. In one embodiment, one of the supports has a tail section which extends beyond the back side of the rigid support. In a preferred embodiment, both the upper and lower supports have a tail section which extends beyond the back side of the rigid support.

A basketball goal may be attached to the parallelogrammic structure. In one embodiment, the basketball goal consists of a rim and backboard. The parallelogrammic structure is configured such that as the parallelogrammic structure deforms, the height of the basketball goal above the playing surface changes, each height corresponding to a different deformation. Since the supports are pivotally mounted, they allow the backboard of the basketball goal to move to several different heights while remaining vertically disposed.

An adjustment lever is pivotally mounted to the back side of the rigid support below the parallelogrammic structure. An extension arm is positioned between the parallelogrammic structure and the adjustment lever. Preferably, one end of the extension arm is pivotally attached to the tail section of the upper and lower supports and the other end of the extension arm is pivotally attached to the adjustment lever. This allows movement of the adjustment lever to deform the parallelogrammic structure and thereby adjust the height of the basketball goal. Thus, the height of the basketball goal can be adjusted without the use of a ladder or other adjustment implement.

The adjustable basketball system of the present invention preferably includes a lockable piston assembly. In one embodiment, the lockable piston assembly is attached to the rigid support and to the adjustment lever. The piston assembly includes a switch which is moveable between a locked position and an unlocked position. The switch is biased toward the locked position. In the locked position, the piston of the piston assembly is prevented from movement within the piston housing. In the unlocked position, the piston can move freely within the piston housing.

The piston assembly also acts as a counterbalance to offset the weight of the basketball goal during adjustment. The piston assembly is attached to the rigid support such that when the switch is in the unlocked position the piston assembly provides a force on the adjustment lever in the opposite direction of the force acting on the adjustment lever due to the weight of the basketball goal. The piston force is preferably substantially equal to the force exerted upon the adjustment lever by the weight of the basketball goal such that the forces are substantially cancel each other. In this condition, the height of the basketball goal can be adjusted quickly and with minimal effort, even by a child.

An actuation trigger is preferably pivotally attached to the adjustment lever such that when one end of the actuation trigger is depressed, the other end engages the piston switch forcing the switch into the unlocked position. The actuation trigger is attached to the adjustment lever such that the trigger can be activated with the same hand that adjusts the adjustment lever. This configuration further adds to the ease with which the height of the basketball goal can be adjusted.

In a preferred embodiment of the present invention, the basketball adjustment system includes an adjustment stop attached to the rigid support. The adjustment stop is positioned to engage the parallelogrammic structure when the basketball goal reaches a predetermined height and prevent the basketball goal from being positioned lower than the predetermined position. In a preferred embodiment, adjustment stops are positioned to limit the range of heights at which the basketball goal can be positioned at both an upper and lower end. Thus, the present invention provides a measure of safety in that the basketball goal cannot collapse below a certain point. Additionally, a person can place an upper adjustment stop such that the parallelogrammic structure will engage the stop when basketball goal is at the standard height of ten feet. Thus, the present invention offers the advantage of being easily repositioned at the standard height after shooting baskets at a lower height.

These and other advantages of the present invention will become more fully apparent by examination of the following description of the preferred embodiments and the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
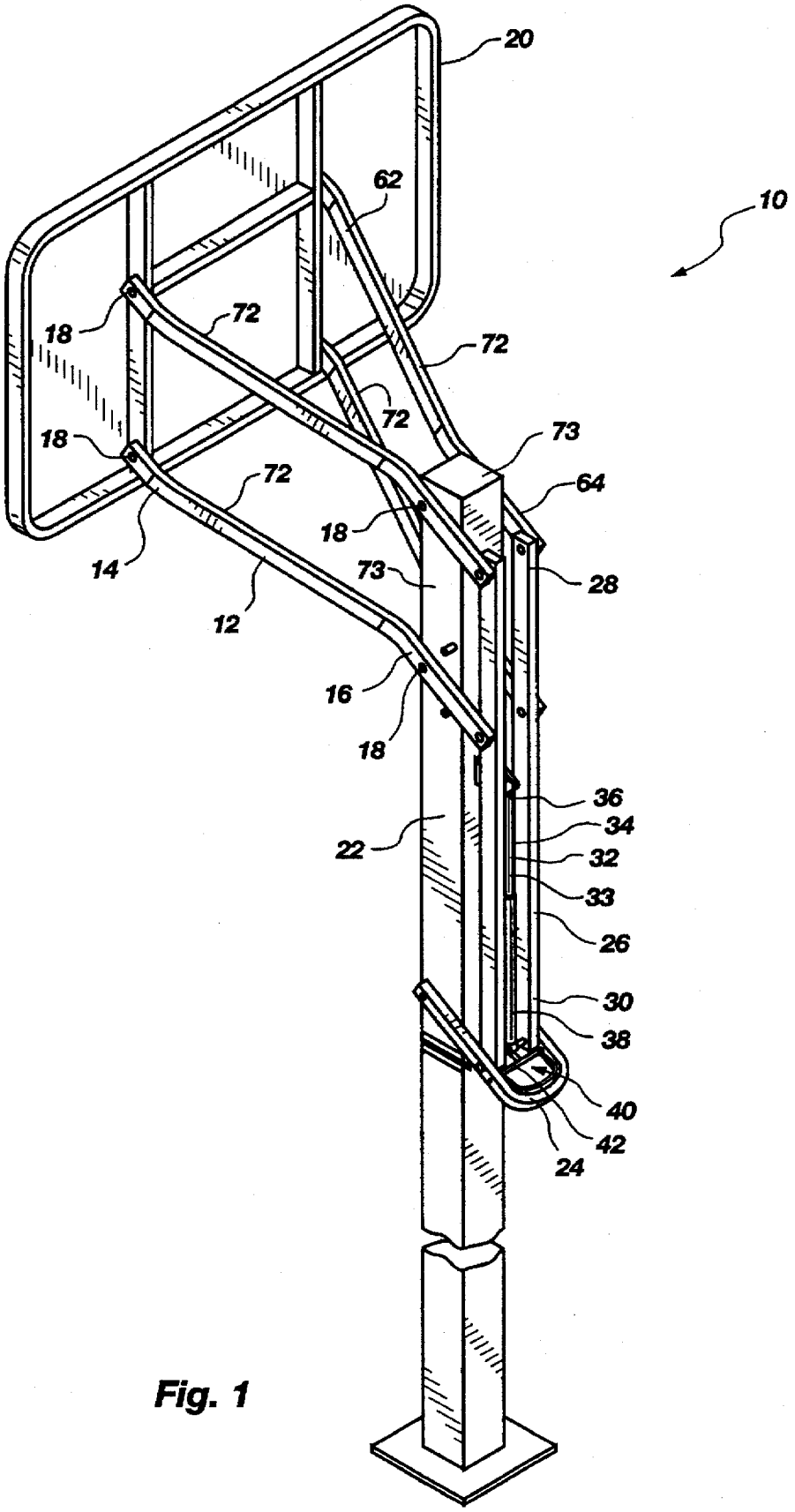
FIG. 1 is a perspective view of one embodiment of the adjustable basketball goal system of the present invention.

Reference is now made to the figures wherein like parts are referred to by like numerals throughout. With particular reference to FIG. 1, an adjustable basketball goal system according to the present invention is generally designated at 10.

The goal system 10 includes a deformable parallelogrammic structure 12 which is deformable into a plurality of configurations. The deformable parallelogrammic structure 12 has a first end 14 and a second end 16. The first end 14 includes means for securing the deformable parallelogrammic structure 12 to a basketball goal.

In one presently preferred embodiment, the means for securing the deformable parallelogrammic structure 12 to the basketball goal comprises bolts 18 positioned through openings (not shown) disposed within the first end 14 of the parallelogrammic structure 12 and within a corresponding hole (not shown) disposed within a frame 20 to which a backboard and rim may be attached. The second end 16 of the deformable parallelogrammic structure 12 includes means for securing the deformable parallelogrammic structure 12 to a rigid support 22 such that the deformable parallelogrammic structure 12 is suspended above the playing surface. In a presently preferred embodiment, the means for securing the deformable parallelogrammic structure 12 to the rigid support 22 consists of bolts 18 positioned with corresponding holes (not shown) within the second end 16 of the deformable parallelogrammic structure 12 and within the rigid support 22. It will be appreciated by persons skilled in the art that there are alternative ways to attach a basketball goal to a parallelogrammic structure and to a rigid support 22. These ways may include pins or pivotal brackets.

The goal system 10 further includes an adjustment lever 24 pivotally mounted to the rigid support 22 below the deformable parallelogrammic structure 12. An extension arm 26 is disposed between and pivotally attached to the parallelogrammic structure 12 and the adjustment lever 24 such that movement of the adjustment lever 24 deforms the parallelogrammic structure 12. As will be discussed in greater detail below, the adjustment lever 24 can be used to deform the parallelogrammic structure into a variety of configurations corresponding to various heights of the basketball goal above the playing surface.

The goal system 10 includes means 32 for restricting the deformation of the parallelogrammic structure 12 at any one of the plurality of configurations such that the basketball goal is suspended above the playing surface at one of a plurality of heights. The means 32 for restricting the deformation has an engaged position wherein the parallelogrammic structure 12 is restricted from deforming and a disengaged position wherein the parallelogrammic structure 12 may be freely deformed allowing the height of the basketball goal to be altered. As will be discussed in greater detail below, the means 32 for restricting the deformation of the parallelogrammic structure 12 in the preferred embodiment comprises a lockable piston assembly 33.

The goal system 10 also includes a biasing member 34 which includes a first end 36 and a second end 38. In one embodiment, the first end 36 of the biasing member 34 is attached to the rigid support 22 and the second end 38 of the biasing member 34 is attached to the adjustment lever 24. The biasing member of the preferred embodiment comprises the same lockable piston assembly 33 used to restrict the deformation of the parallelogrammic structure 12. The biasing member 34 is positioned such that when the restricting means 32 is in the disengaged position, the biasing member 34 provides a force on the adjustment lever 24 in the opposite direction of the force acting on the adjustment lever 24 due to the weight of the basketball goal. This configuration minimizes the force required to adjust the basketball goal.

It will be appreciated by those of skill in the art that one or more biasing members 34 may be attached in a variety of ways to minimize the force required to adjust the basketball goal. These ways may include, but are not limited to attaching one end of the biasing member to the rigid support and the other end of the biasing member to the deformable parallelogrammic structure 12 or to the extension arm 26.

The goal system 10 also includes releasing means 40 for moving the restricting means 32 from the engaged position to the disengaged position. In one preferred embodiment, the releasing means comprises an actuation trigger 42. As will be discussed in detail below, the actuation trigger 42 is positioned for engagement with the restricting means such that when the actuation trigger 42 is engaged, the restricting means moves from the engaged position to the disengaged position allowing the height of the basketball goal to be adjusted.

Figure 2:
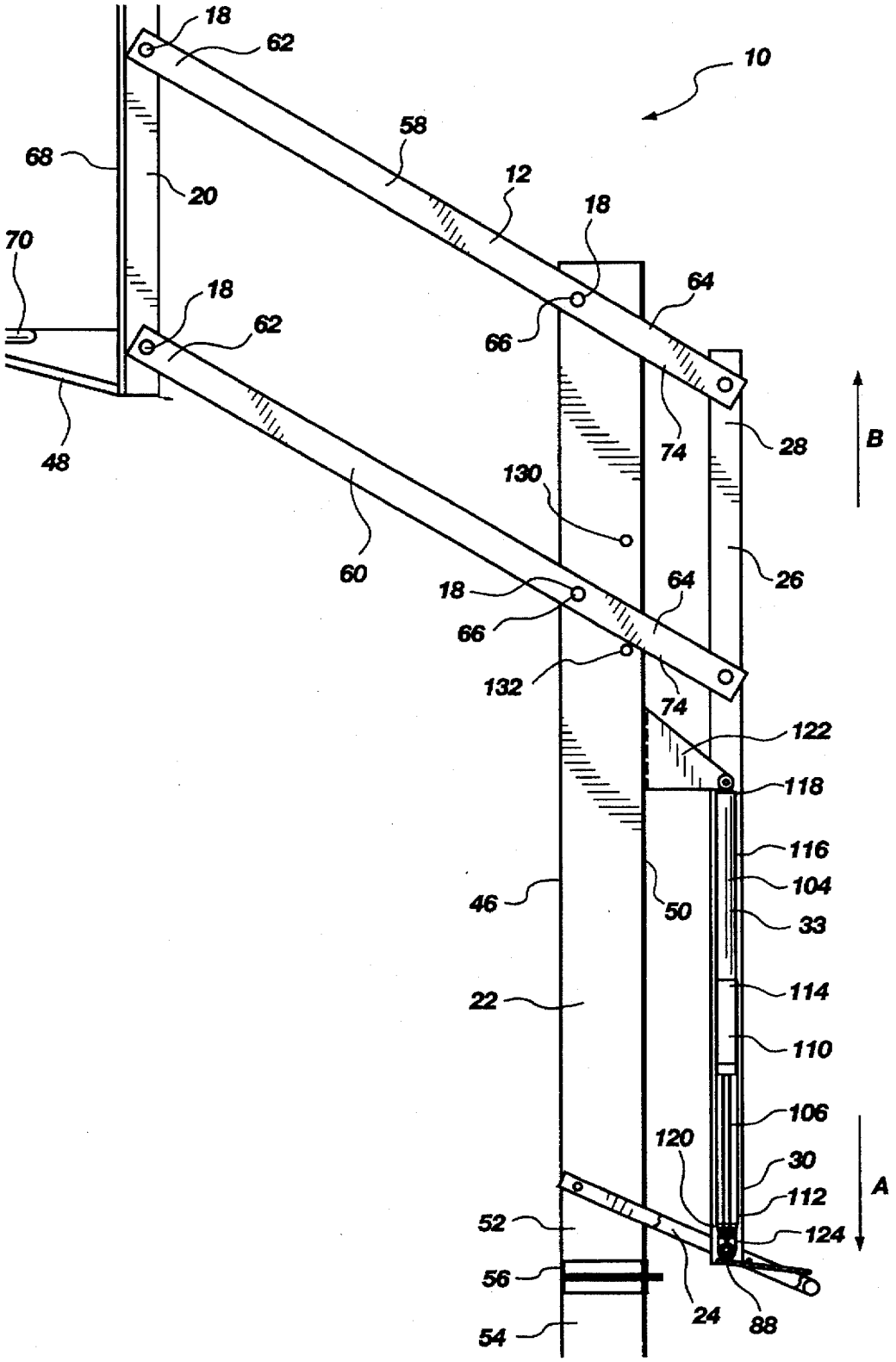
FIG. 2 is a side partial cross sectional view of the adjustable basketball goal system of FIG. 1.

With reference now to FIG. 2, a cross-sectional view of the piston of the preferred embodiment of the present invention is shown. The adjustable basketball goal system 10 includes a rigid support 22 extending in a substantially upward direction. The rigid support 22 has a goal side 46 adjacent a basketball goal 48 and a back side 50 opposite the goal side 46. The rigid support comprises at least two pole sections 52 and 54 capable of being secured to each other. The embodiment of the rigid support 22 illustrated in FIG. 2 shows the rigid support 22 having an upper section 52 and a lower section 54 secured together with plates 56. In one presently preferred embodiment, each section 52 and 54 includes an abutment plate 36 secured to one end of each support section 52 and 54 such that the abutment plates 56 can be positioned next to each other and such that the abutment plates 56 can be bolted together to secure the support sections 52 and 54 to each other. This configuration allows the support sections 52 and 54 of the rigid support 22 to be packaged in a much smaller container while still providing the desired rigidity when secured together to support the parallelogrammic structure 12.

In one presently preferred embodiment, the rigid support 22 has a square cross-section which provides added strength to the rigid support 22 and also provides a flat surface to which the deformable parallelogrammic structure 12 may be attached.

It will be appreciated by those of skill in the art that there are many ways known in the art in which to configure a rigid support for suspending a basketball goal 48 above a playing surface. For example, a one-piece or multi-piece pole with a circular cross-section may be used. It will further be appreciated that there are multiple ways known in the art to secure rigid support sections together.

Referring still to FIG. 2, the deformable parallelogrammic structure 12 of the adjustable basketball goal system 10 comprises an upper support 58 and a lower support 60. The upper and lower supports, 58 and 60 each have a first ends 62 and a second end 64. In a presently preferred embodiment, the first end 62 of the upper and lower supports 58 and 60, are pivotally attached to a basketball frame 20 by means of bolts 18 positioned through corresponding openings within the first end 62 of the upper and lower supports 58 and 60, and openings within the frame 20. The upper and lower supports 58 and 60, are each pivotally attached to the rigid support 22 at a pivot point 66 adjacent the second ends 64 of the supports 58 and 60. In one presently preferred embodiment, the upper and lower supports 58 and 60, are pivotally attached to the rigid support 22 by positioning bolts 18 through corresponding openings within the second end 64 of the upper and lower supports 58 and 60 adjacent the pivot point 66 and within openings in the rigid support 22.

The basketball goal 48 of the present invention comprises a backboard 68 and a rim 70. The backboard 68 is attached to the frame 20. It will be appreciated by those of skill in the art that a variety of goals may be used which would provide an opening through which a basketball may pass.

The upper support 58, lower support 60, rigid support 22, and frame 20 define the deformable parallelogrammic structure 12. In the presently preferred embodiment of FIG. 2, the rigid support 22 is substantially vertical to a playing surface and the backboard 68 is positioned substantially parallel to the rigid support 22. The rim 70 is positioned to be substantially horizontal. Because the upper support 58 and the lower support 60 are pivotally mounted at each end 62 and 64, the parallelogrammic structure 12 can be deformed to reposition the height of the basketball goal 48 while allowing the backboard 68 and rim 70 to remain vertically and horizontally disposed, respectively.

With brief reference to FIG. 1, the upper and lower supports 58 and 60, each comprise adjacent bars 72. The bars 72 are bent such that the bars 72 converge from the first end 62 of the upper and lower supports 58 and 60, where the bars 72 are attached to the frame 20 to the second end 64 of the upper and lower supports 58 and 60, where the bars 72 are attached to opposite sides 73 of the rigid support 22. It will be appreciated by those of skill in the art that the upper and lower supports, 58 and 60 may be configured in a variety of ways so long as the parallelogrammic configuration, which allows the height of the basketball goal 48 to be adjusted, is maintained.

Referring again to FIG. 2, in one preferred embodiment, at least one of the supports 58 and 60, includes a tail section 74 which extends beyond the rigid support 22 at the back side 50 of the rigid support 22 adjacent the second end 64 of said support. In a preferred embodiment, both of the upper and lower supports, 58 and 60 have a tail section 74 which extends beyond the back side 50 of the rigid support 22. The tail sections 74 of the upper and lower supports, 58 and 60 provide a place to link the parallelogrammic structure to the adjustment lever 24 which is preferably pivotally mounted adjacent the back side 50 of the rigid support 22 below the parallelogrammic structure 12. Being located on the back side 50 of the rigid support 22, the adjustment lever 24 is less likely to interfere with basketball play.

As can be seen in the preferred embodiment of FIG. 2, the extension arm 26 links the parallelogrammic structure 12 to the adjustment lever 24 which obviates the need for a ladder, pole, or separate adjustment tool. The extension arm 26 of the present invention has a first end 28 and a second end 30. In one embodiment, the first end 28 of the extension arm 26 is pivotally attached to the tail section 74 of one of the upper or lower supports, 58 and 60. In a presently preferred embodiment, the first end 28 of the extension arm 26 is attached to tail section 74 of both the upper and lower supports, 58 and 60. The second end 30 of the extension arm 26 is pivotally attached to the adjustment lever 24 such that the extension arm 26 is substantially parallel to the rigid support 22 adjacent the back side 50 of the rigid support 22.

Figure 3:
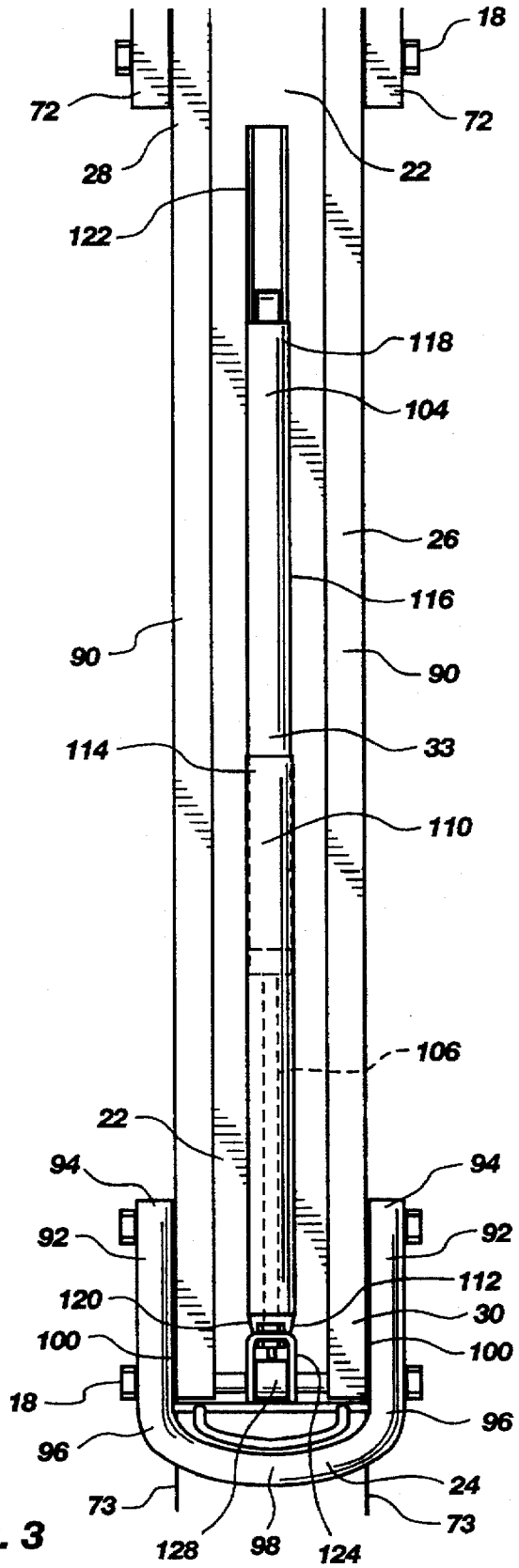
FIG. 3 is a back plan view of a portion of the adjustable basketball goal system of FIG. 1.

With reference now to FIG. 3, the extension arm 26 includes two substantially parallel bars 90. The substantially parallel bars 90 are pivotally attached at the first end 28 of the extension arm 26 to the adjacent bars 72 of the upper and lower supports, 58 and 60. The adjustment lever 24 includes a U-shaped member having side sections 92. A first end 94 of the side sections 92 is attached to opposite sides 73 of the rigid support 22. A curved section 98 of the U-shaped adjustment lever 24 connects the second ends 96 of the side sections 92. The substantially parallel bars 90 are pivotally attached at the second end 30 of the extension arm 26 to an inside surface 100 of the side sections 92 of the U-shape adjustment lever 24 adjacent the second end 96 of each side section 92. The parallel bars 90 of the extension arm 26 are pivotally attached to the adjacent bars 72 of the upper and lower supports 58 and 60 adjacent the tail sections 74 and to the side sections 92 of the adjustment lever 24 by means of bolts 18 positioned through corresponding openings in the parallel bars 90 and the adjacent bars 72 and through corresponding openings in the parallel bars 90 and the side sections 92.

It will be appreciated by those of skill in the art that the adjustment lever 24 of the present invention can be configured in a variety of ways to obtain the lever action utilized in the present invention. It will also be appreciated that the extension arm 26 can be configured in a variety of ways and still be able to link the deformable parallelogrammic structure 12 to the adjustment lever 24 at a location accessible to basketball players of all ages.

Figure 4:
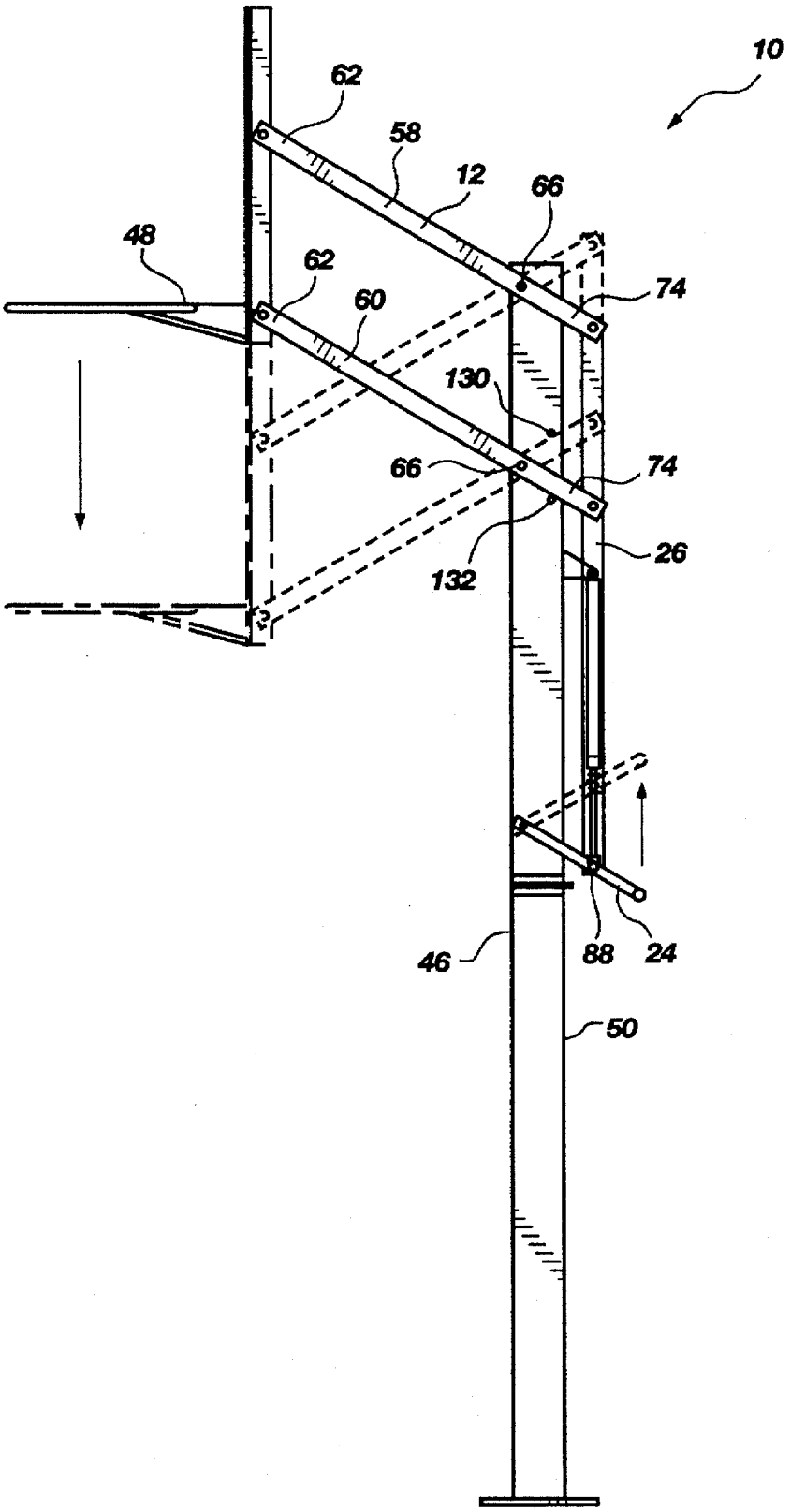
FIG. 4 is a side plan view of the adjustable basketball goal system of FIG. 1 showing an alternative position for the basketball goal in phantom lines.

With reference now to FIG. 4, the extension arm 26 places the adjustment lever 24 in communication with the deformable parallelogrammic structure 12. The adjustment lever 24 is movable through a range of positions with each position corresponding to one of a variety of configurations of the parallelogrammic structure 12. At each configuration, the basketball goal 48 is disposed at a different height above the playing surface.

It will be appreciated by those of skill in the art that basketball goal 48 and the extension arm 26 are positioned at a distance from the rigid support 22 such that the point of attachment 88 between the extension arm 26 and the adjustment lever 24 and the pivot points 66 act as fulcrums and the adjustment lever 24 and the upper and lower supports 58 and 60 act as levers. This positioning provides the system with a mechanical advantage, in which a relatively small movement of the adjustment lever 24 causes a correspondingly larger movement of the basketball goal 48.

The extension arm 26 is positioned to remain substantially parallel to the rigid support 22 as the height of the basketball goal 48 is adjusted. Thus, there is little danger of an arm or other limb becoming wedged or pinched between the extension arm 26 and the rigid support 22 because there is no scissor action between the extension arm 26 and the rigid support 22.

It will be appreciated by those of skill in the art, that the adjustment lever 24 may be positioned adjacent the goal side 46 of the rigid support 22. In this embodiment, the upper support 58 and lower support 60 need not have a tail section 74 because the extension arm 26 could be attached to the supports 58 and 60 between the pivot points 66 and the first end 62 of each support, 58 and 60. It will further be appreciated by those of skill in the art that positioning the adjustment lever 24 adjacent the goal side 46 of the rigid support 22 may interfere with basketball play.

With reference now to FIGS. 2 and 3, the adjustable basketball goal system 10 includes a lockable piston assembly 33 used to restrict the deformation of the parallelogrammic structure at any one of a plurality of configurations. The lockable piston assembly 33 includes a piston housing 104, a piston (not shown) slidably located within the piston housing 104, and a rod 106 attached to the piston. As can best be seen by reference to FIGS. 5 and 6, the lockable piston assembly 33 includes a switch 108 which is moveable between a locked position, in which the piston is prevented from movement within the piston housing 104, and an unlocked position, in which the piston is movable within the piston housing 104. The switch 108 is preferably biased toward the locked position. The lockable piston assembly 33 of the present invention uses a combination of gas and fluid for adjustment in both directions and may include any of those commercially available lockable piston assemblies known for such use.

Referring again to FIGS. 2 and 3, the adjustable basketball goal system 10 of the present invention also includes a shroud 110. The shroud 110 is in telescopic engagement with the piston housing 104. A first end 112 of the shroud 110 is attached to the rod 106. As the rod 106 moves within the piston housing 104, a second end 114 of the shroud 110 movably engages an outside surface 116 of the piston housing 104. In this configuration, the lockable piston assembly 33 is strengthened and prevented from buckling under the rigors of basketball play, which sometimes include people hanging from the rim.

The lockable piston assembly 33 includes a first end 118 adjacent the piston housing 104 and a second 120 end adjacent the rod 106. The first end 118 of the lockable piston assembly 33 is attached to a bracket 122 which is affixed to the rigid support 22. The second end 120 of the lockable piston assembly 33 is preferably configured with a U-shaped mounting piece 124 secured to the shroud 110 such that the switch 108 is exposed within the U-shaped mounting piece 124. The U-shaped mounting piece 124 has openings through which the bolt 18 used to pivotally secure the extension arm 26 to the adjustment lever 24 passes. Thus, the rod 106 moves in association with the movement of the adjustment lever 24. It will be appreciated that the second end 120 of the lockable piston assembly 33 could be attached to either the extension arm 26, or the adjustment lever 24, without being attached to both with one bolt 18.

In one presently preferred embodiment, the lockable piston assembly 33 is positioned between parallel bars 90 of the extension arm 26. This configuration provides the lockable piston assembly 33 with protection against being hit by the basketball or other object.

Referring now to FIG. 2, the lockable piston assembly 33 also serves as a biasing member which counterbalances the weight of the basketball goal 48. It will be appreciated that the weight of the basketball goal 48 exerts a gravitational force on the adjustable basketball goal system 10. For example, the gravitational force will pull basketball goal 48 toward the playing surface. Thus, because of the pivotal attachment of the parallelogrammic structure 12 to the rigid support 22, an upward force will be exerted on the extension arm 26, and the adjustment lever 24. When the switch 108 is in the unlocked position, the piston assembly provides a force A on the adjustment lever 24 in the opposite direction of the gravitational force B acting on the adjustment lever 24 through the extension arm 26 due to the weight of the basketball goal 48.

In a preferred embodiment, the piston force A is substantially equal to the gravitational force B exerted upon the adjustment lever 24 by the weight of the basketball goal 48. Thus, the forces substantially cancel each other allowing the height of the basketball goal 48 to be adjusted with minimal effort.

The lockable piston assembly 33 of the preferred embodiment loses approximately 2% of its biasing strength annually. However, the initial amount of force A exerted by the piston assembly can be preset at the time of assembly of the adjustable basketball goal system 10. Thus, depending upon the anticipated life of the lockable piston assembly 33, the force A can be set to be slightly greater than the gravitational force B exerted by the weight of the basketball goal 48. As the piston force A gradually depreciates over the lifetime of the lockable piston assembly 33, the piston force A will eventually become slightly less than the gravitational force B. Accordingly, with force A being greater than force B initially, the basketball goal 48 will tend to float upwardly when the switch 108 is in the unlocked position. Later in time, when force A is less than force B, the basketball goal 48 will tend to float downwardly when the switch 108 is in the unlocked position. It will be appreciated by those of skill in the art that the system can be set up such that the differences between the forces (A minus B) and (B minus A) will be minimal over a substantial period of time. Thus, during this time, the forces will substantially counterbalance each other and any resulting force in either direction can easily be overcome by the user moving the adjustment lever 24, even if that user is a child.

It will be appreciated by those of skill in the art that the lockable piston assembly 33 can be positioned in a variety of places to accomplish the teachings of the this invention. For example, if the adjustment lever 24 were positioned adjacent the goal side 46 of the rigid support 22 the lockable piston assembly 33 might be attached to the rigid support 22 below the adjustment lever 24. Further, the lockable piston assembly 33 could be attached to the upper and lower supports 58 and 60 of the deformable parallelogrammic structure 12 and still create a force A component which would counterbalance the gravitational force B indirectly exerted on the adjustment lever 24 by the weight of the basketball goal 48.

It will also be appreciated by those of skill in the art that the lockable piston assembly 33 may be oriented to push or pull against a desired piece to achieve the counterbalancing effect. In the preferred embodiment, the lockable piston assembly 33 is oriented with the piston housing 104 positioned above the rod 106. It will be appreciated that in this configuration, gravity may direct fluids located within the piston housing 104 into engagement with a grommet (not shown) centering the rod 106 within the housing, thus making the piston self-lubricating.

It will also be appreciated that a combination of springs or pistons may used which each have a force component in the opposite direction of the gravitational force B such that when the force components are combined, the sum is substantially equal to, and opposite, force B. For example, a biasing spring may be located within the deformable parallelogrammic structure 12 creating a force component in the opposite direction to force B such that the lockable piston assembly 33 need not exert as much force in that same direction. It will further be appreciated that if the biasing member, whether a spring, piston assembly, or other member, is contained completely in the deformable parallelogrammic structure 12, the extension arm 26 would not be under constant tension as it is in the preferred embodiment, and could be constructed from lesser strength material. The embodiment illustrated in the drawings is preferred for its efficiency of design, its strength, and its aesthetic look.

Figure 5:
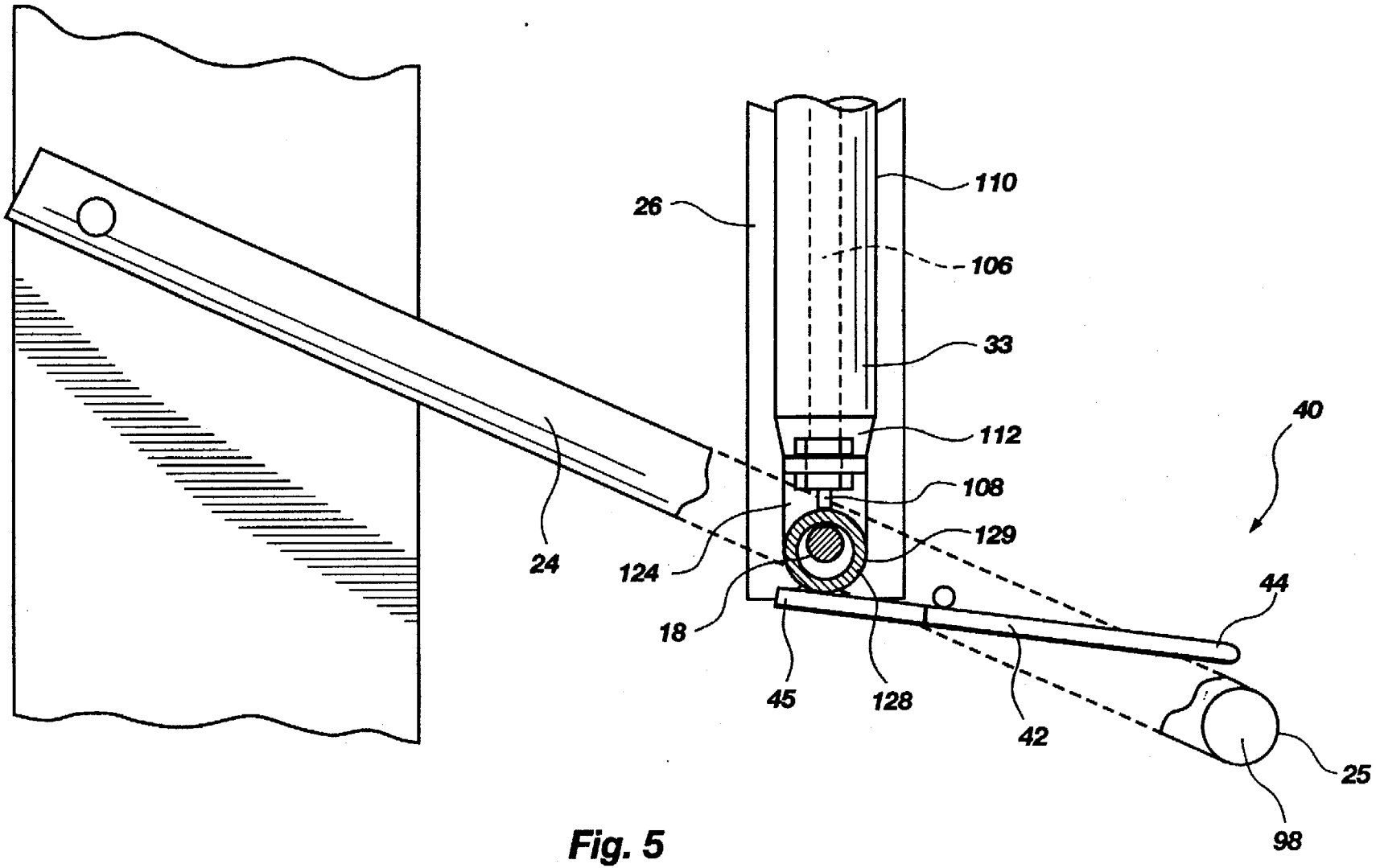
FIG. 5 is a partially cut away, cross sectional view of the adjustment lever of the adjustable basketball goal system of FIG. 1 with the actuation trigger in the rest position.
Figure 6:
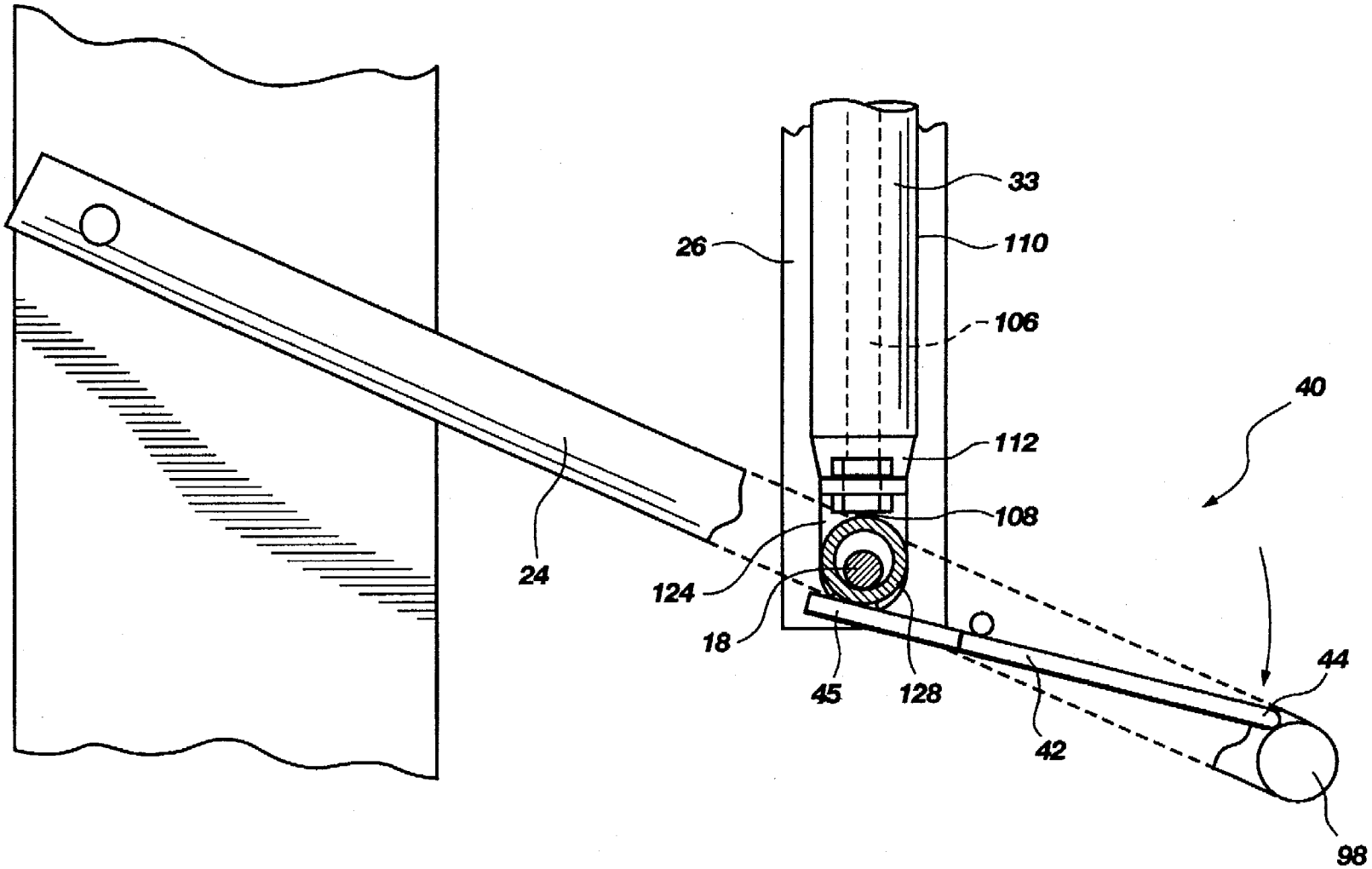
FIG. 6 is a partially cut away, cross sectional view of the adjustment lever of FIG. 5 with the actuation trigger in the actuated position.

Referring now to FIGS. 5 and 6, the adjustable basketball goal system 10 includes releasing means 40 for moving the restricting means 32 from the engaged position to the disengaged position. In a presently preferred embodiment, the releasing means 40 includes an actuation trigger 42 pivotally attached to the adjustment lever 24. The actuation trigger 42 includes a first end 44 and a second end 45. The actuation trigger 42 is preferably pivotally attached to the adjustment lever 24 between the first end 44 and the second end 45. The first end 44 of the actuation trigger 42 is preferably positioned adjacent a first end 25 of the adjustment lever 24 which in the preferred embodiment is the curved section 98. This configuration allows a person to engage the actuation trigger 42 and the adjustment lever 24 with the same hand.

In the embodiment illustrated in FIGS. 5 and 6, the first end 44 of the actuation trigger 42 is preferably positioned above the first end 25 of the adjustment lever 24 such that the first end 44 of the actuation trigger 42 can not pivot below the first end 25 of the adjustment lever 24. In this configuration, a person can not hang from the first end 44 of the actuation trigger 42 which may cause the actuation trigger 42 to bend or break.

The second end 45 of the actuation trigger 42 is positioned adjacent the switch 108 such that as the first end 44 is depressed, the second end 45 pivots into engagement with the switch 108 forcing the switch 108 into the unlocked position. In a presently preferred embodiment, the second end 45 is configured with a tube member 128. The bolt 18 which pivotally attaches the extension arm 26 to the adjustment lever 24 passes through the tube member 128. The tube member 128 has an inner diameter which is larger than the outer diameter of the bolt 18, thus defining a range of pivotal motion for the actuation trigger 42.

It will be appreciated by those of skill in the art that the difference between the inner diameter of the tube member 128 and the diameter of the bolt 18 allows for slight lateral movement of the tube member 128 with respect to the bolt 18. This configuration allows the switch 108 to slide along an outer surface 129 of the tube member 128 while the adjustment lever 24, thus allowing the actuation trigger to remain in an actuation position (FIG. 6) with the switch 108 in the locked position, through the full range of motion of the adjustment lever 24.

As can be seen with reference to FIG. 3, the tube member 128 is preferably positioned within the U-shaped mounting piece 124. As discussed above, the switch 108 is biased in the locked position in which the switch 108 projects outwardly. The outward bias of the switch 108 in turn keeps the actuation trigger 42 in a rest position (FIG. 5) until the first end 44 of the actuation trigger 42 is depressed forcing the actuation trigger 42 into an actuated position (FIG. 6) in which the tube member 128 engages the switch 108 and overcomes the outward bias of the switch 108 unlocking the piston assembly 33.

It will be appreciated by those of skill in the art that the actuation trigger 42 may have independent biasing means to keep the actuation trigger 42 in the rest position. It will further be appreciated that the actuation trigger 42 can be configured in a variety of ways in order to release the restricting means 32. For example, if the lockable piston assembly 33 is positioned away from the adjustment lever 24, the actuation trigger 42 may include a cable or other mechanism to move the switch 108 from the locked position to the unlocked position. Further, if the adjustable basketball goal system 10 is counterbalanced using a spring instead of the lockable piston assembly 33, the trigger may include a rod biased to engage a series of openings in the rigid support 22, thus locking the adjustment lever 24 in place until the rod is removed from one of the openings. It will be appreciated by those of skill in the art that it is preferable to configure the actuation trigger 42 such that the actuation trigger 42 can remain in the actuation trigger 42 throughout the desired range of motion of the adjustment lever 24.

With reference now to FIGS. 2 and 4, the adjustable basketball goal system 10 includes at least one adjustment stop and preferably at least one upper adjustment stop 130 and at least one lower adjustment stop 132 attached to the rigid support 22. The upper adjustment stop 132 is positioned on the rigid support 22 such that when the basketball goal 48 is at a predetermined highest position above the playing surface, the parallelogrammic structure 12 engages the upper adjustment stop 132 thereby preventing the basketball goal 48 from being positioned higher than the predetermined highest position. The lower adjustment stop 130 is positioned on the rigid support 22 such that when the basketball goal 48 is at a predetermined lowest position above the playing surface, the parallelogrammic structure 12 engages the lower adjustment stop 130 thereby preventing the basketball goal 48 from being positioned below the predetermined lowest position.

In a presently preferred embodiment, the upper adjustment stop 132 is positioned below the lower support 60 and the lower adjustment stop 130 is positioned above the lower support 60. The lower and upper adjustment stops 130 and 132 define a range of heights in which the basketball goal 48 may be positioned. In a one embodiment, the adjustment stops 130 and 132 are positioned on the rigid support 22 to define a range of heights between about 7 feet and about 10 feet. In a preferred embodiment, the adjustment stops 130 and 132 are positioned on the rigid support 22 to define a range of heights between 7½ feet and 10 feet.

It will be appreciated that one or more adjustment stops may be positioned to engage the upper and/or lower supports 58 and 60 and/or the adjustment lever 24 to practice the teachings of this invention. It will further be appreciated by those of skill in the art that the adjustment stops 130 and 132 provide a safety function by prohibiting the basketball goal 48 from crashing down upon a player. The adjustment stops can further be positioned to correspond to a predetermined height such as the standard height of 10 feet, thereby allowing the basketball goal 48 to be easily positioned at that height.

Referring now to FIGS. 4, 5, and 6, the adjustable basketball goal system 10 is utilized by grasping the adjustment lever 24 and simultaneously depressing the actuation trigger 42 with the same hand. This unlocks the lockable piston assembly 33. The adjustment lever 24 can then be moved which deforms the deformable parallelogrammic structure 12, repositioning the height of the basketball goal 48 above the playing surface. Once the basketball goal 48 is at the desired height, the actuation trigger 42 is released, locking the lockable piston assembly 33 and preventing the basketball goal 48 from further movement. The same steps are followed to reposition the basketball goal 48.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An adjustable basketball goal system allowing for adjustment of the height of a basketball goal above a playing surface, comprising:

a deformable parallelogrammic structure, the parallelogrammic structure being deformable into a plurality of configurations wherein at each configuration the basketball goal is disposed at a different height above the playing surface;

means for securing the deformable parallelogrammic structure to a rigid support such that the parallelogrammic structure is suspended above the playing surface;

means for attaching the basketball goal to said parallelogrammic structure;

means for restricting the deformation of the parallelogrammic structure at any one of the plurality of configurations such that the basketball goal is suspended above the playing surface at one of a plurality of heights, the means for restricting the deformation having an engaged position wherein the parallelogrammic structure is restricted from deforming and a disengaged position wherein the parallelogrammic structure may be freely deformed allowing the height of the basketball goal to be altered;

releasing means for moving the restricting means from the engaged position to the disengaged position, an adjustment lever pivotally mounted to the rigid support below the parallelogrammic structure;

an extension arm disposed between the parallelogrammic structure and the adjustment lever, the extension arm being pivotally attached to the parallelogrammic structure and the adjustment lever such that movement of the adjustment lever deforms the parallelogrammic structure; and a biasing member attached to the rigid support such that when the restricting means is in the disengaged position the biasing member provides a force which substantially counterbalances the gravitational force acting on the adjustable basketball goal system created by the weight of the basketball goal.

2. The adjustable basketball goal system of claim 1, wherein the biasing member provides a force on the adjustment lever that is substantially equal to the force exerted in the opposite direction by the weight of the basketball goal, thereby allowing the height of the basketball goal to be adjusted with minimal effort.

3. The adjustable basketball goal system of claim 1, wherein the restricting means is biased in the engaged position.

4. The adjustable basketball goal system of claim 1, wherein the means for restricting the deformation of the parallelogrammic structure at any one of the plurality of configurations comprises a lockable piston assembly comprising a piston housing, a piston slidably located within the piston housing, and a rod attached to the piston, the lockable piston assembly having a switch moveable between a locked position, in which the piston is prevented from movement within the piston housing, and an unlocked position, in which the piston is movable within the piston housing.

5. The adjustable basketball goal system of claim 4, wherein the releasing means for moving the restricting means from the engaged position to the disengaged position comprises an actuation trigger pivotally attached to the adjustment lever, the actuation trigger positioned for engagement with the switch such that when the actuation trigger is in an actuated position, the switch is in the unlocked position and such that when the actuation trigger is in a rest position, the switch is in the locked position.

6. The adjustable basketball goal system of claim 1, wherein the biasing member comprises a piston assembly.

7. The adjustable basketball goal system of claim 1, wherein the rigid support has a goal side and a back side opposite the goal side.

8. The adjustable basketball goal system of claim 7, wherein the rigid support comprises at least two pole sections capable of being secured to each other.

9. The adjustable basketball goal system of claim 7, wherein the parallelogrammic structure comprises an upper support and a lower support, the upper and lower supports each having a first end and a second end, the upper and lower supports being attached to the rigid support at a pivot point adjacent the second end and wherein the second end of at least one of said supports comprises a tail section extending beyond the back side of said rigid support opposite the first end.

10. The adjustable basketball goal system of claim 9, wherein the extension arm is pivotally attached to the tail section and pivotally attached to the adjustment lever such that the extension arm is substantially parallel to the rigid support.

11. An adjustable basketball goal system allowing for adjustment of the height of a basketball goal above a playing surface, comprising:

a rigid support having a goal side and a back side opposite the goal side;

a deformable parallelogrammic structure being attached to the goal side of the rigid support such that the parallelogrammic support is suspended above a playing surface, the parallelogrammic structure being deformable into a plurality of configurations;

a basketball goal attached to the parallelogrammic structure opposite the rigid support wherein at each of said configurations the basketball goal is disposed at a different height above the playing surface;

an adjustment lever pivotally mounted to the rigid support below the parallelogrammic structure;

an extension arm disposed between the parallelogrammic structure and the adjustment lever, the extension arm being pivotally attached adjacent to the parallelogrammic structure and being pivotally attached to the adjustment lever such that movement of the adjustment lever deforms the parallelogrammic structure;

a lockable piston assembly comprising a piston housing, a piston slidably located within the piston housing, and a rod attached to the piston, the lockable piston assembly having a switch moveable between a locked position, in which the piston is prevented from movement within the piston housing, and an unlocked position, in which the piston is movable within the piston housing, the lockable piston assembly being attached to the rigid support such that when the switch is in the unlocked position the piston assembly provides a force to substantially counterbalance the gravitational force acting on the adjustable basketball goal system due to the weight of the basketball goal, the piston force being substantially equal to the force exerted upon the adjustment lever by the weight of the basketball goal, thereby allowing the height of the basketball goal to be adjusted with minimal effort; and an actuation trigger pivotally attached to the adjustment lever for engagement with the switch, such that when the actuation trigger is in an actuated position, the switch is in the unlocked position and such that when the actuation trigger is in a rest position, the switch is in the locked position.

12. The adjustable basketball goal system of claim 11, wherein the rigid support extends in a substantially upright position.

13. The adjustable basketball goal system of claim 11, further comprising a shroud in telescopic engagement with the piston housing, a first end of the shroud being attached to the rod such that as the rod moves within the piston housing, a second end of the shroud movably engages an outside surface of the piston housing.

14. The adjustable basketball goal system of claim 11, wherein the switch is biased toward the locked position.

15. The adjustable basketball goal system of claim 14, wherein the actuation trigger comprises a first end and a second end, the actuation trigger being pivotally attached to the adjustment lever between the first end and the second end.

16. The adjustable basketball goal system of claim 15, wherein the first end of the actuation trigger is positioned adjacent a first end of the adjustment lever such that a person can engage the actuation trigger and the adjustment lever with one hand.

17. The adjustable basketball goal system of claim 15, wherein the second end is positioned adjacent the switch such that as the first end is depressed, the second end pivots into engagement with the switch thereby forcing the switch into the unlocked position.

18. The adjustable basketball goal system of claim 11, wherein the parallelogrammic structure comprises an upper support and a lower support, the upper and lower supports each having a first end and a second end, the upper and lower supports being attached to the rigid support at a pivot point adjacent to second end, and wherein the second end of at least one of said supports comprises a tail section extending beyond the rigid support at the back side of said rigid support, the tail section being pivotally attached to the extension arm.

19. The adjustable basketball goal system of claim 18, wherein the extension arm is pivotally attached to the tail support and pivotally attached to the adjustment lever such that the extension arm is substantially parallel to the rigid support.

20. The adjustable basketball goal system of claim 18, wherein both the upper support and the lower support have a tail section which extends beyond the back side of the rigid support opposite the first end of said supports, each tail section being pivotally attached to the adjustment arm.

21. The adjustable basketball goal system of claim 11, wherein the adjustment lever is pivotally mounted to the rigid support adjacent the back side of the support.

22. The adjustable basketball goal system of claim 11, further comprising at least one adjustment stop attached to the rigid support such that when the basketball goal is at a predetermined lowest position above the playing surface, the parallelogrammic structure engages the adjustment stop thereby preventing the basketball goal from being positioned below the predetermined lowest position.

23. The adjustable basketball goal system of claim 11, further comprising at least one adjustment stop attached to the rigid support such that when the basketball goal is at a predetermined highest position above the playing surface, the parallelogrammic structure engages the adjustment stop thereby preventing the basketball goal from being positioned higher than the predetermined highest position.

24. The adjustable basketball goal system of claim 11, wherein the extension arm comprises two substantially parallel bars.

25. An adjustable basketball goal system allowing for adjustment of the height of a basketball goal above a playing surface, comprising:

a rigid support having a goal side and a back side opposite the goal side the rigid support extending in a substantially upward direction;

a deformable parallelogrammic structure being attached to the goal side of the rigid support such that the parallelogrammic support is suspended above a playing surface, the deformable parallelogrammic structure comprising an upper support and a lower support, each of said upper and lower supports having a first end and a second end, the upper and lower supports being pivotally attached to the rigid support at a pivot point between the first end and the second end of each support, each support having a tail section extending beyond the back side of the rigid support, the parallelogrammic structure being deformable into a plurality of configurations;

a basketball goal attached to the goal side of the rigid support wherein at each of said plurality of configurations, the basketball goal is disposed at a different height above the playing surface;

an adjustment lever pivotally mounted to the rigid support adjacent the back side of the rigid support below the parallelogrammic structure;

an extension arm disposed between the parallelogrammic structure and the adjustment lever, a first end of the extension arm being pivotally attached to the tail section of the upper and lower support and a second end of the extension arm being pivotally attached to the adjustment lever such that movement of the adjustment lever deforms the parallelogrammic structure, and such that the extension arm is substantially parallel to the rigid support;

a lockable piston assembly comprising a piston housing, a piston slidably located within the piston housing, and a rod attached to the piston, the lockable piston assembly having a switch moveable between a locked position, in which the piston is prevented from movement within the piston housing, and an unlocked position, in which the piston is movable within the piston housing, the lockable piston assembly having a first end attached to the rigid support and a second end attached to the adjustment lever such that when the switch is in the unlocked position the piston assembly provides a force on the adjustment lever in the opposite direction of the force acting on the adjustment lever due to the weight of the basketball goal, the piston force being substantially equal to the force exerted upon the adjustment lever by the weight of the basketball goal, thereby allowing the height of the basketball goal to be adjusted with minimal effort;

a shroud in telescopic engagement with the piston housing, a first end of the shroud being in communication with the rod such that as the rod moves within the piston housing, the shroud moves outside the housing;

an actuation trigger comprising a first end and a second end, the first end of the actuation trigger positioned adjacent to a first end of the adjustment lever such that a person can engage the actuation trigger and move the adjustment lever with one hand, a plunger being affixed to the second end of the actuation trigger, the actuation trigger being pivotally attached to the adjustment elver between the first and second ends such that when the first end of the actuation trigger is depressed, the plunger pivots into the switch overcoming the outward bias of the switch and forcing the switch into the unlocked position;

at least one lower adjustment stop attached to the rigid support such that when the basketball goal is at a predetermined lowest position above the playing surface, the parallelogrammic structure engages the lower adjustment stop and is prevented from further deformation corresponding to a position lower than the predetermined position; and at least one upper adjustment stop attached to the rigid support such that when the basketball goal is at a predetermined highest position above the playing surface, the parallelogrammic structure engages the upper adjustment stop and is prevented from further deformation corresponding to a position higher than the predetermined position.

26. The adjustable basketball goal system of claim 25, wherein the upper and lower adjustment stops define a range of heights in which the basketball goal may be positioned, said range being between about 7 feet and about 10 feet.

27. The adjustable basketball goal system of claim 25, wherein the extension arm comprises two substantially parallel bars.

* * * * *